US010596406B2

(12) United States Patent
Avila

(10) Patent No.: US 10,596,406 B2
(45) Date of Patent: Mar. 24, 2020

(54) LEG STRETCHING AND RAISING WORKOUT APPARATUS

(71) Applicants: Race Wu, Taichung (TW); Steve John Avila, Milton, WA (US)

(72) Inventor: Steve John Avila, Milton, WA (US)

(73) Assignees: RACE WU, Taichung (TW); Steve John Avila, Milton, WA (US)

( * ) Notice: Subject to any disclaimer, the term of this patent is extended or adjusted under 35 U.S.C. 154(b) by 61 days.

(21) Appl. No.: 15/997,095

(22) Filed: Jun. 4, 2018

(65) Prior Publication Data

US 2018/0290009 A1 Oct. 11, 2018

Related U.S. Application Data

(63) Continuation-in-part of application No. 15/622,993, filed on Jun. 14, 2017, now abandoned.

(30) Foreign Application Priority Data

Apr. 11, 2017 (TW) ..... 106205003 U
Apr. 12, 2018 (CN) ..... 2018 2 0523899 U

(51) Int. Cl.
*A63B 21/00* (2006.01)
*A63B 23/04* (2006.01)
(Continued)

(52) U.S. Cl.
CPC ..... *A63B 21/4015* (2015.10); *A61H 1/0244* (2013.01); *A61H 1/0266* (2013.01);
(Continued)

(58) Field of Classification Search
CPC ..... A63B 21/4015; A63B 23/04; A63B 2023/006; A63B 2208/0204;
(Continued)

(56) References Cited

U.S. PATENT DOCUMENTS 2,216,214 A * 10/1940 Schilling ..... A63B 25/00 623/28
7,179,206 B2 * 2/2007 Backes ..... A61H 1/0266 482/80

(Continued)

*Primary Examiner* — Gary D Urbiel Goldner
(74) *Attorney, Agent, or Firm* — Muncy, Geissler, Olds & Lowe, PC

(57) ABSTRACT

A leg stretching and raising workout apparatus include: a load bearing unit having a base for underpinning a shoe/foot and cord-penetrating openings disposed at the base; at least one fastening unit having a cord connected to the cord-penetrating openings to fasten the shoe or foot, and two anchoring portions disposed bilaterally; and two pulling cord members each having a pulling cord, and a cord connecting portion connected to a corresponding one of the anchoring portions. Another leg stretching and raising workout apparatus includes: a load bearing unit having a base for underpinning a shoe/foot, cord-penetrating openings disposed at the base, and two anchoring portions disposed bilaterally; at least one fastening unit having a cord connected to the cord-penetrating openings to fasten the shoe or foot; and two pulling cord members each having a pulling cord and a cord connecting portion connected to a corresponding one of the anchoring portions.

10 Claims, 13 Drawing Sheets

(51) Int. Cl.
*A61H 1/02* (2006.01)
*A63B 23/00* (2006.01)

(52) U.S. Cl.
CPC ..... *A63B 23/04* (2013.01); *A61H 1/024* (2013.01); *A61H 2201/0157* (2013.01); *A61H 2201/1261* (2013.01); *A61H 2201/165* (2013.01); *A61H 2201/1642* (2013.01); *A63B 2023/006* (2013.01); *A63B 2208/0204* (2013.01)

(58) Field of Classification Search
CPC ..... A61H 1/0244; A61H 1/0266; A61H 2201/165; A61H 2201/1261; A61H 1/024; A61H 2201/0157; A61H 2201/1642
See application file for complete search history.

(56) References Cited

U.S. PATENT DOCUMENTS

| | | | | |
|---|---|---|---|---|
| 7,192,410 | B1 * | 3/2007 | Rodgers | A61F 5/00 482/79 |
| 7,794,368 | B2 * | 9/2010 | Rutherford | A43B 5/00 482/129 |
| 8,376,796 | B1 * | 2/2013 | Vock | A63B 31/11 441/64 |
| 9,017,235 | B2 * | 4/2015 | Khademi | A63B 21/0557 482/121 |
| 2019/0184227 | A1 * | 6/2019 | Gouzenko | A63B 22/16 |

* cited by examiner

LEG STRETCHING AND RAISING WORKOUT APPARATUS

CROSS-REFERENCE TO RELATED APPLICATION

This application is a Continuation-in-Part of co-pending application Ser. No. 15/622,993, filed on Jun. 14, 2017, for which priority is claimed under 35 U.S.C. § 120; and this application claims priority of Application No. 201820523899.9 filed in China on Apr. 12, 2018 and Application No. 106205003 filed in Taiwan on Apr. 11, 2017 under 35 U.S.C. § 119; the entire contents of all of which are hereby incorporated by reference.

BACKGROUND OF THE INVENTION

1. Technical Field

The present invention relates to workout equipment and, more particularly, to a leg stretching and raising workout apparatus which features ease of use.

2. Description of Related Art

Conventional leg stretching and raising workout apparatuses are inconvenient to put on, lack ease of use, and are not designed to fit shoes or feet of all sizes. In view of this, conventional leg stretching and raising workout apparatuses have room for improvement.

SUMMARY OF THE INVENTION

In view of the aforesaid drawbacks of the prior art, it is an objective of the present invention to provide a leg stretching and raising workout apparatus which is convenient to put on and features ease of use.

In order to achieve the above and other objectives, the present invention provides a leg stretching and raising workout apparatus, comprising: a load bearing unit having a base for underpinning a shoe or foot, a plurality of cord penetrating openings disposed at the base, and an anchoring portion; at least one fastening unit each having a cord fastened to a corresponding one of the cord penetrating openings of the load bearing unit, thereby enabling the cord to be fastened to the shoe or foot; and a pulling cord member having a pulling cord and a cord connecting portion connected to the anchoring portion of the load bearing unit.

Since the at least one fastening unit and the load bearing unit are coupled together, the at least one fastening unit can be conveniently, quickly, and firmly fastened to the shoe or foot, thereby achieving the objective of the present invention.

Preferably, the load bearing unit comprises a front securing plate, and the front securing plate has the cord penetrating openings, allowing the at least one fastening unit to be penetratingly disposed at at least one of the cord penetrating openings, respectively.

Preferably, the base and the front securing plate are connected by a bent portion.

Preferably, the load bearing unit has a rear securing portion, and the rear securing portion has the cord penetrating openings, allowing the at least one fastening unit to be penetratingly disposed at at least one of the cord penetrating openings, respectively.

Preferably, the bottom portion and the rear securing portion are connected by a bent portion.

Preferably, the load bearing unit comprises a first support component, a second support component, and a connecting member for coupling together the first support component and the second support component.

Preferably, the connecting member has an upper coupling component and a lower coupling component, with the upper coupling component coupled to the first support component, and the lower coupling component coupled to the second support component.

Preferably, the upper coupling component and an operating element are pivotally connected by a pivot and thus can rotate relative to each other by a predetermined angle.

Preferably, the first support component has a plurality of positioning recesses, and the second support component has a plurality of positioning blocks meshing with the plurality of positioning recesses of the first support component.

Preferably, the upper coupling component has a tenon, and the lower coupling component has an escape groove penetrable by the tenon of the upper coupling component.

In order to achieve the above and other objectives, the present invention further provides a leg stretching and raising workout apparatus, comprising: a load bearing unit having a base for underpinning a shoe or foot; a plurality of cord penetrating openings disposed at the base; at least one fastening unit each having a cord fastened to a corresponding one of the cord penetrating openings of the load bearing unit, thereby enabling the cord to be fastened to the shoe or foot, and two anchoring portions disposed on left and right sides, respectively; and two pulling cord members each having a pulling cord and a cord connecting portion connected to a corresponding one of the anchoring portions of the fastening unit.

Since the fastening unit and the load bearing unit are coupled together, the fastening unit can be conveniently, quickly, and firmly fastened to the shoe or foot, thereby achieving the objective of the present invention.

Preferably, the load bearing unit has a first support component, a second support component, and a connecting member for coupling together the first support component and the second support component.

Preferably, the connecting member has an upper coupling component and a lower coupling component. The upper coupling component is coupled to the first support component, whereas the lower coupling component is coupled to the second support component. The upper coupling component connects pivotally to an operating element with a pivot and thus rotate by a predetermined angle.

Preferably, the first support component has a plurality of positioning recesses, the second support component has a plurality of positioning blocks meshing with the positioning recesses of the first support component, the upper coupling component has a tenon, and the lower coupling component has an escape groove penetrated by the tenon of the upper coupling component.

Preferably, the load bearing unit has a bottom portion, a bent portion, and a rear securing portion such that the cord penetrating openings are disposed at the rear securing portion and penetrable by the fastening unit, thereby allowing the bottom portion and the rear securing portion to be connected by the bent portion.

In order to achieve the above and other objectives, the present invention provides a leg stretching and raising workout apparatus, comprising: a load bearing unit having a base for underpinning a shoe or foot, a plurality of cord penetrating openings disposed at the base, and two anchoring portions disposed on two sides, respectively; at least one fastening unit having a cord connected to the plurality of cord penetrating openings of the load bearing unit and adapted to fasten the shoe or foot in place; and two pulling cord members each having a pulling cord and a cord connecting portion connected to a corresponding one of the anchoring portions of the load bearing unit.

Since the fastening unit and the load bearing unit are coupled together, the fastening unit can be conveniently, quickly, and firmly fastened to the shoe or foot, thereby achieving the objective of the present invention.

Preferably, the load bearing unit has a first support component, a second support component, and a connecting member for coupling together the first support component and the second support component.

Preferably, the connecting member has an upper coupling component and a lower coupling component. The upper coupling component is coupled to the first support component. The lower coupling component is coupled to the second support component. The upper coupling component connects pivotally to an operating element with a pivot and thus rotate by a predetermined angle.

Preferably, the first support component has a plurality of positioning recesses, the second support component has a plurality of positioning blocks meshing with the plurality of positioning recesses of the first support component, the upper coupling component has a tenon, and the lower coupling component has an escape groove penetrated by the tenon of the upper coupling component.

Preferably, the load bearing unit has a bottom portion, a bent portion, and a rear securing portion such that the cord penetrating openings are disposed at the rear securing portion and penetrable by the fastening unit, thereby allowing the bottom portion and the rear securing portion to be connected by the bent portion.

DETAILED DESCRIPTION OF THE EMBODIMENT OF THE INVENTION

Figure 1:
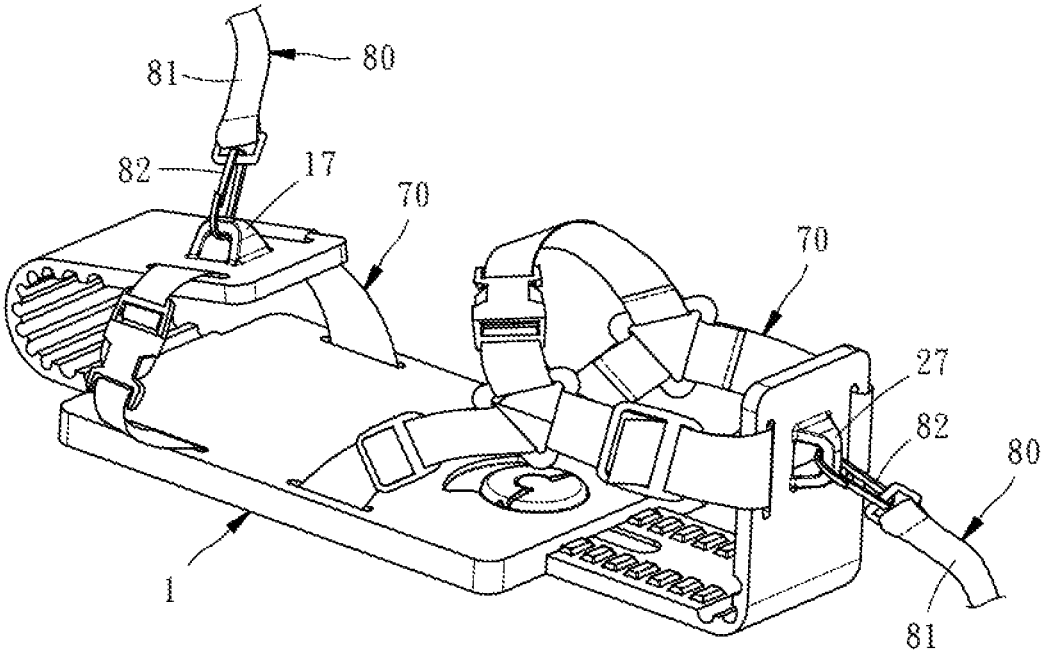
FIG. 1 is a perspective view of a leg stretching and raising workout apparatus in accordance with a preferred embodiment of the present invention.
Figure 2:
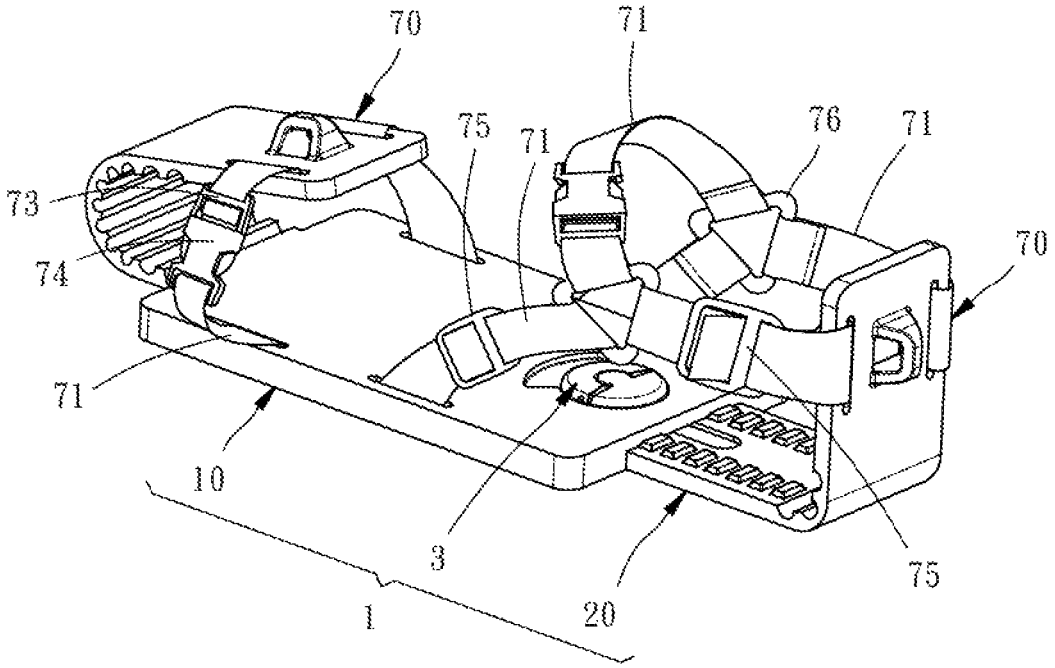
FIG. 2 is a perspective view of the leg stretching and raising workout apparatus with pulling cord members removed therefrom in accordance with the preferred embodiment of the present invention.
Figure 3:
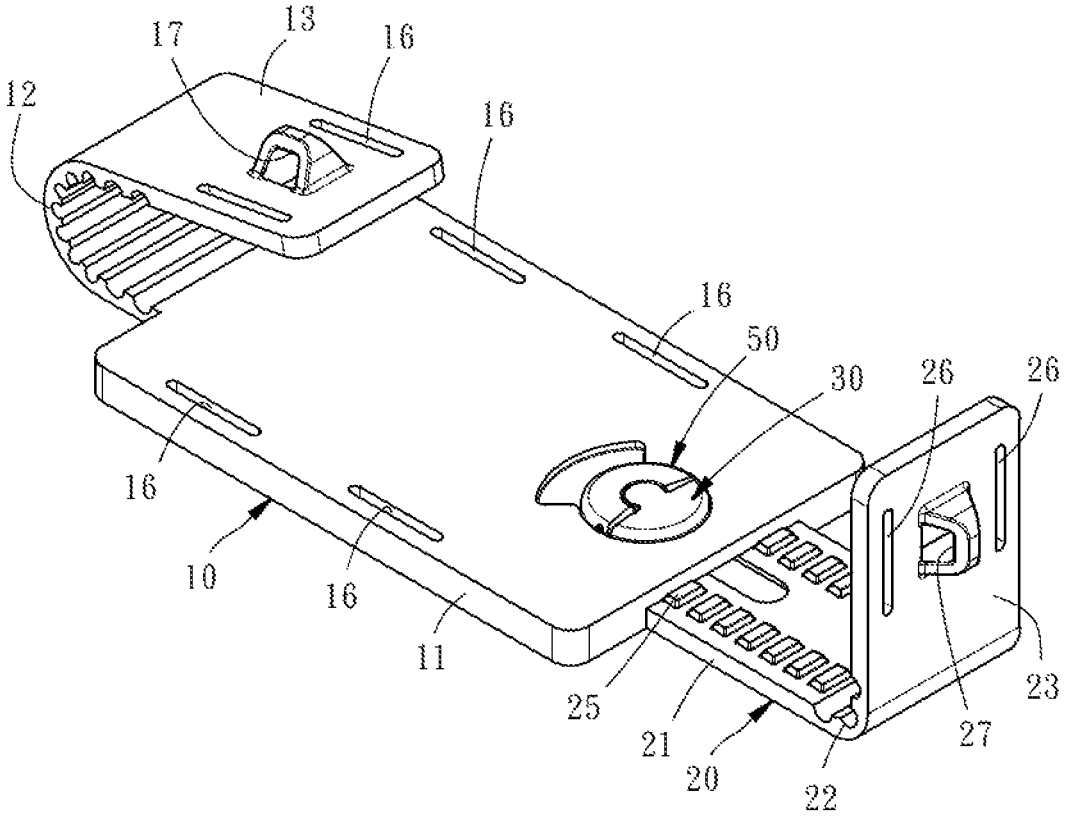
FIG. 3 is a perspective view of the leg stretching and raising workout apparatus with both pulling cord members and fastening units removed therefrom in accordance with the preferred embodiment of the present invention.
Figure 4:
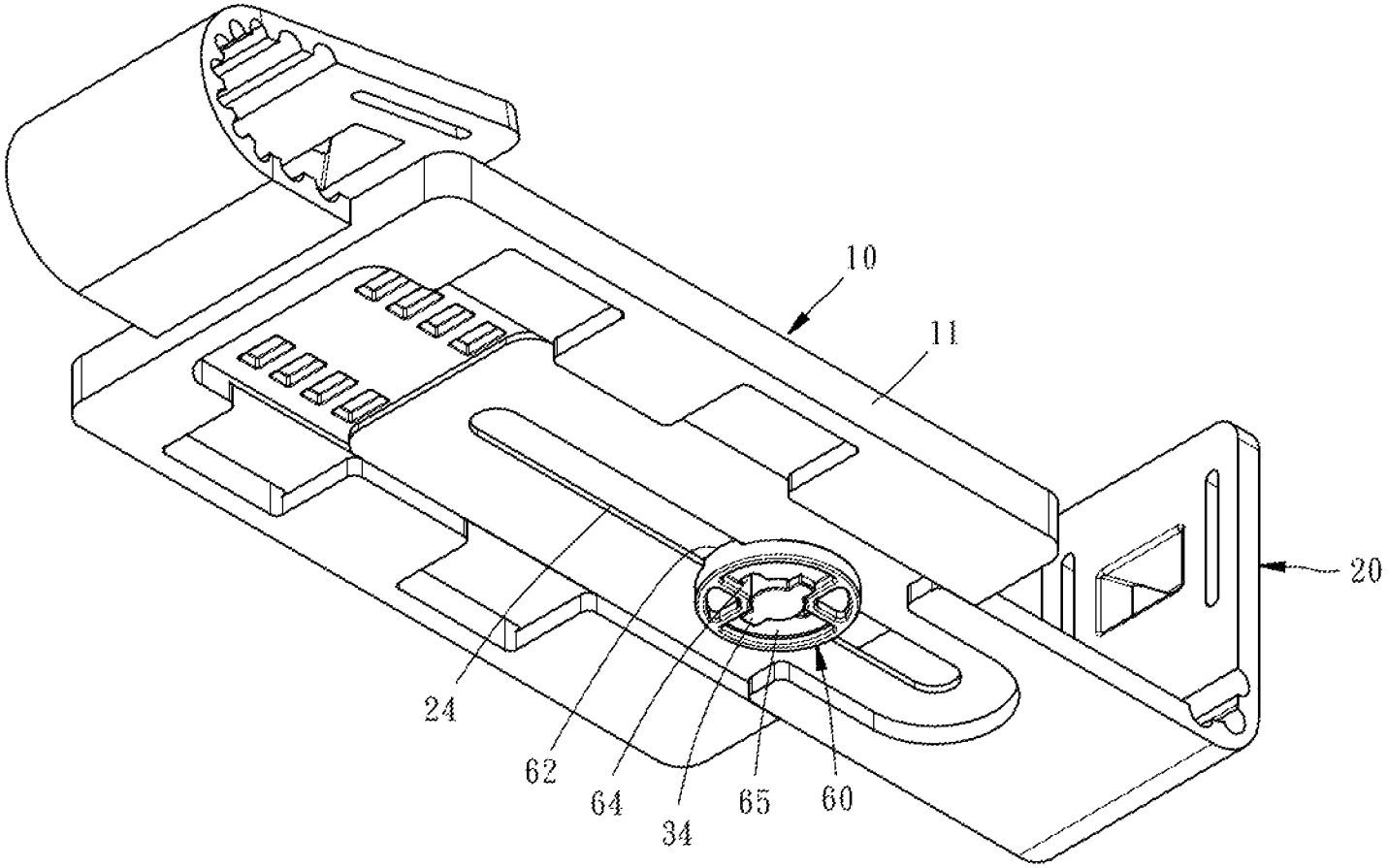
FIG. 4 is a perspective view of the leg stretching and raising workout apparatus shown in FIG. 3 but taken from another angle.
Figure 5:
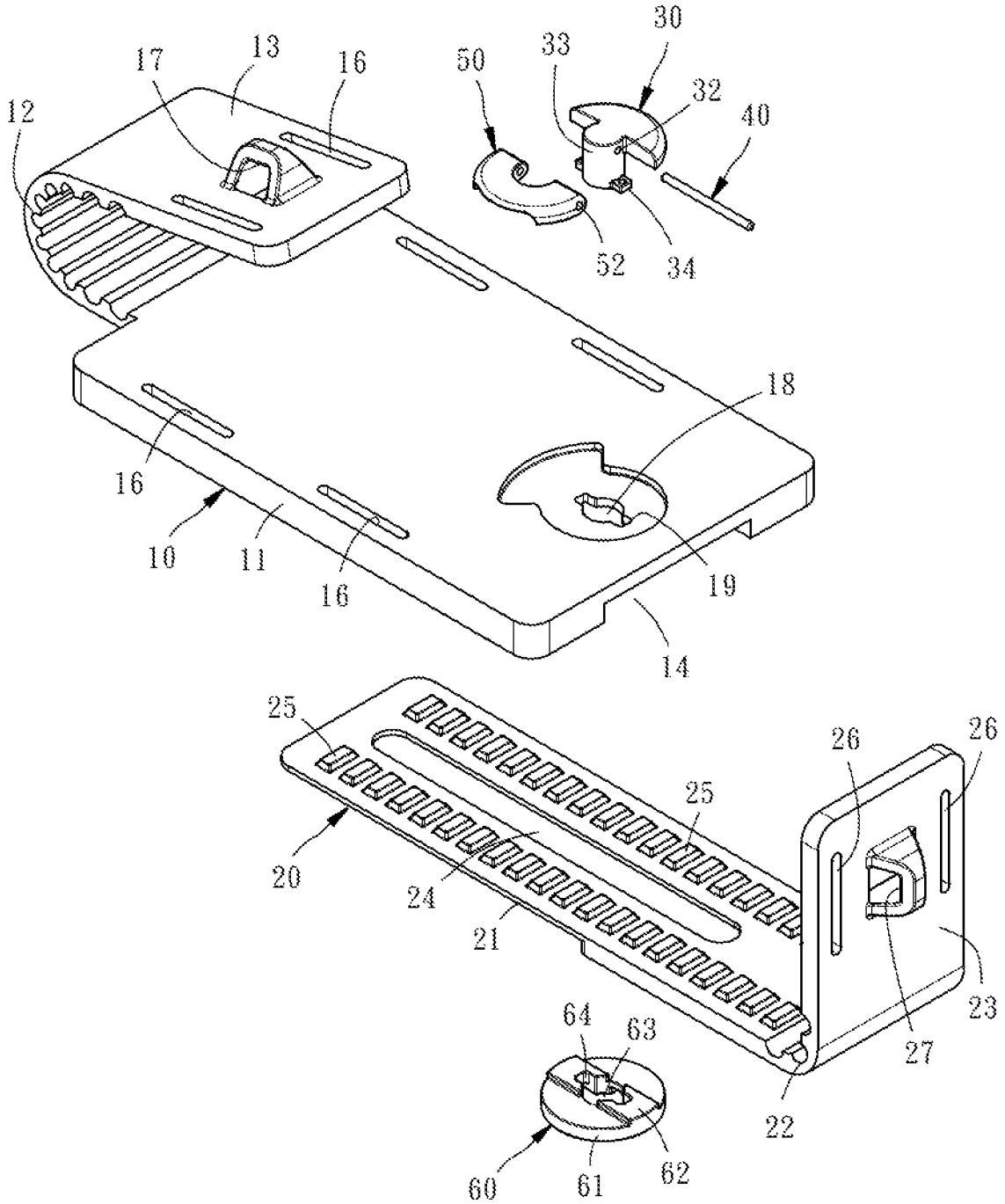
FIG. 5 is an exploded view of the leg stretching and raising workout apparatus shown in FIG. 3.
Figure 6:
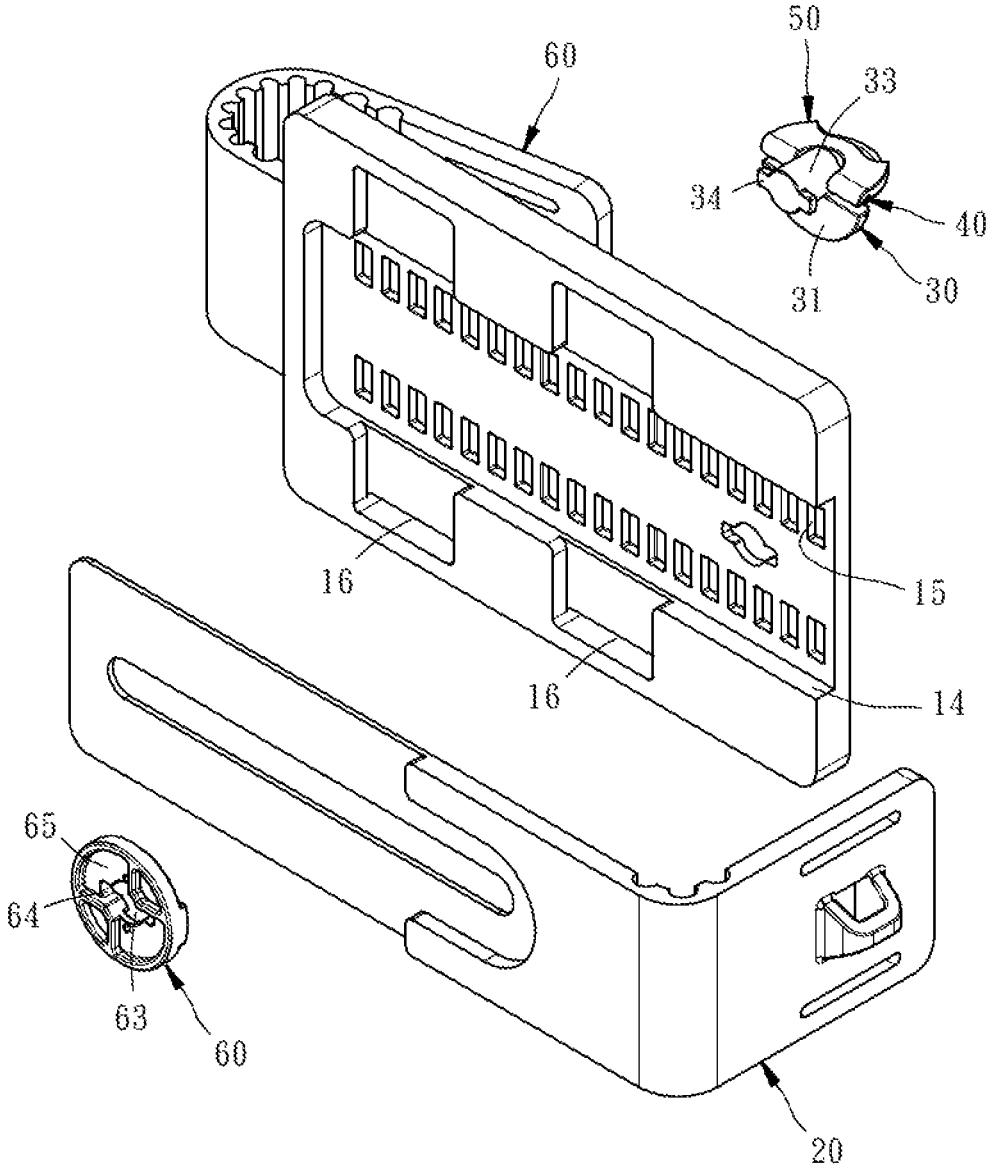
FIG. 6 is an exploded view of the leg stretching and raising workout apparatus shown in FIG. 5 but taken from another angle.
Figure 7:
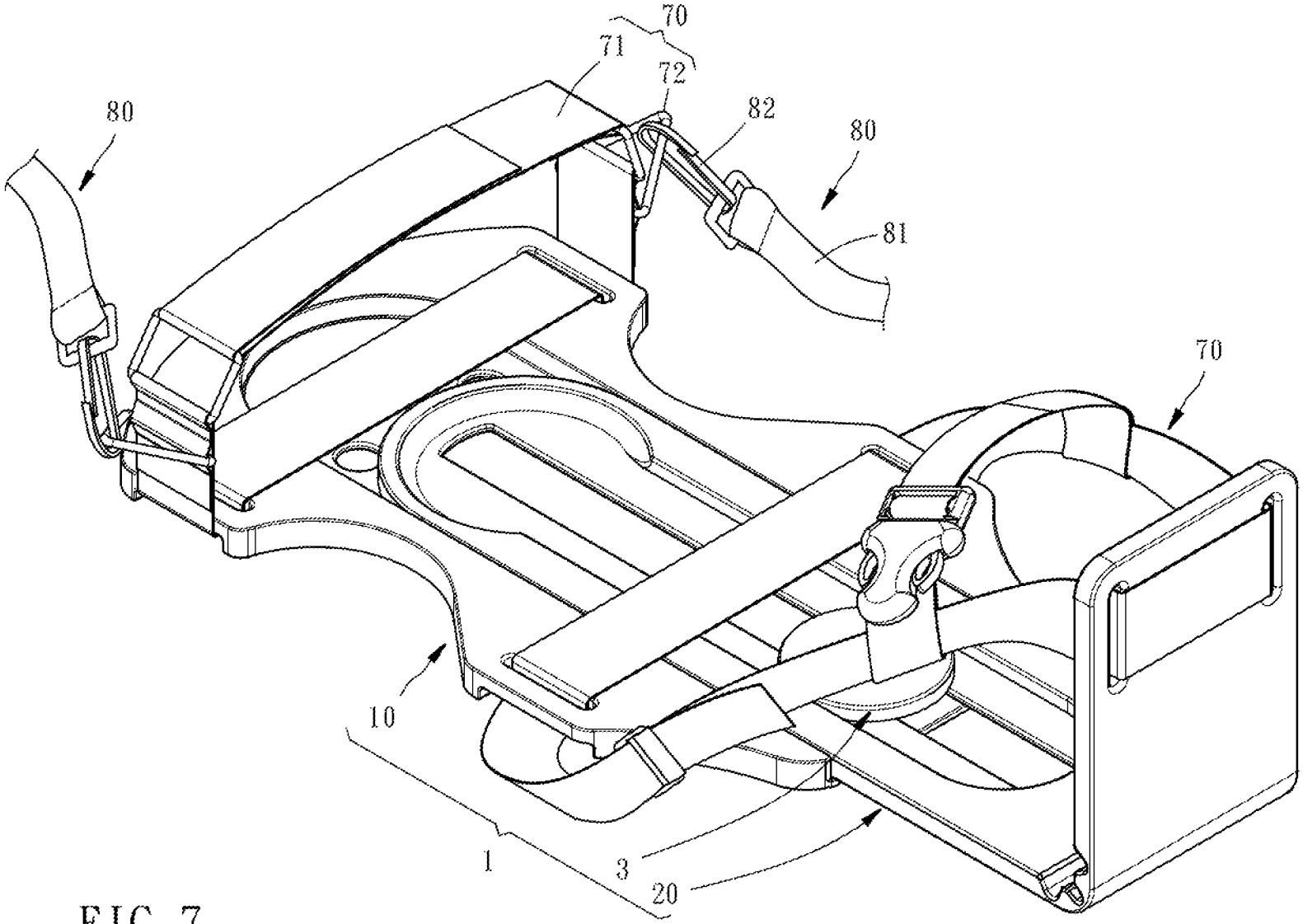
FIG. 7 is a perspective view of the leg stretching and raising workout apparatus in accordance with another preferred embodiment of the present invention.
Figure 8:
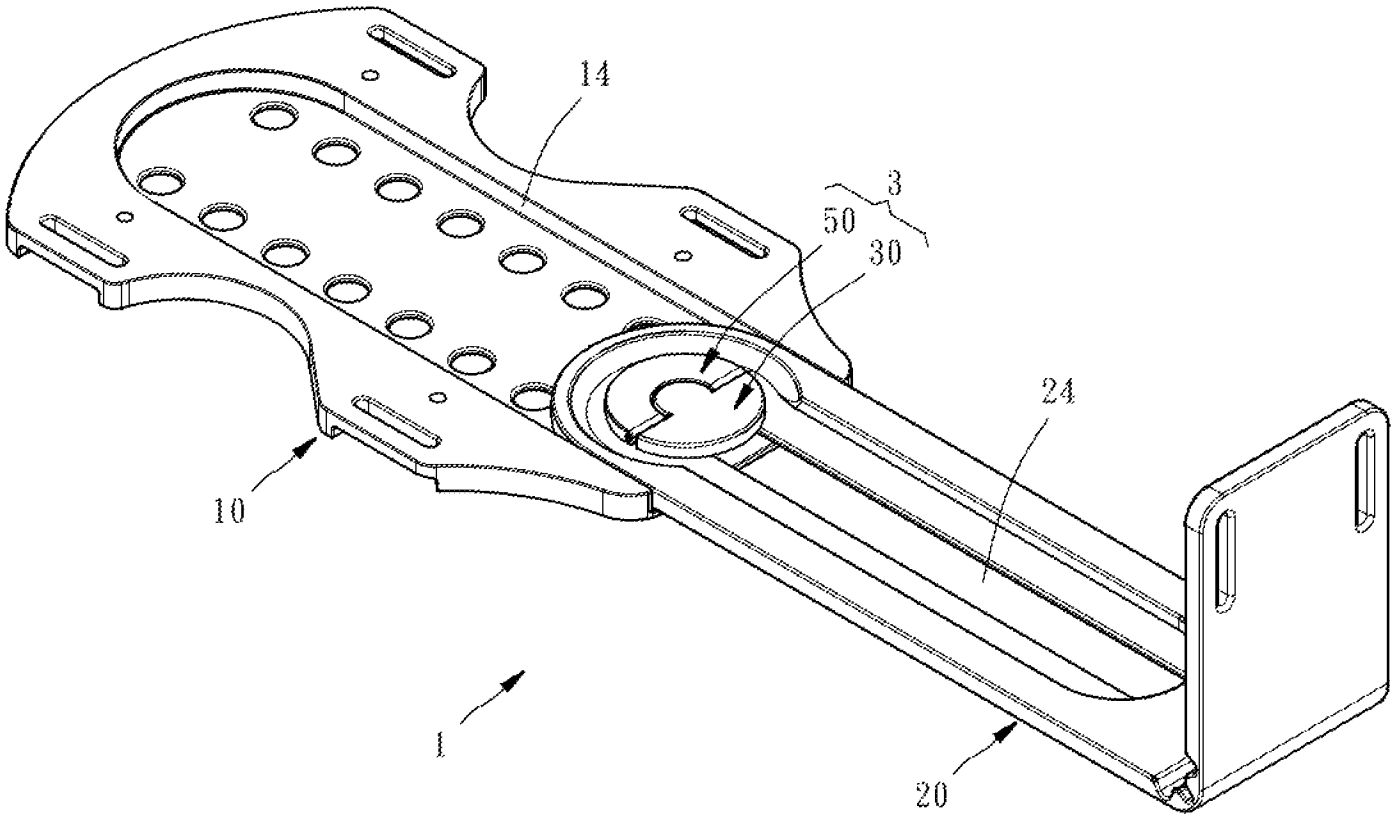
FIG. 8 is a perspective view of a load bearing unit in accordance with another preferred embodiment of the present invention.
Figure 9:
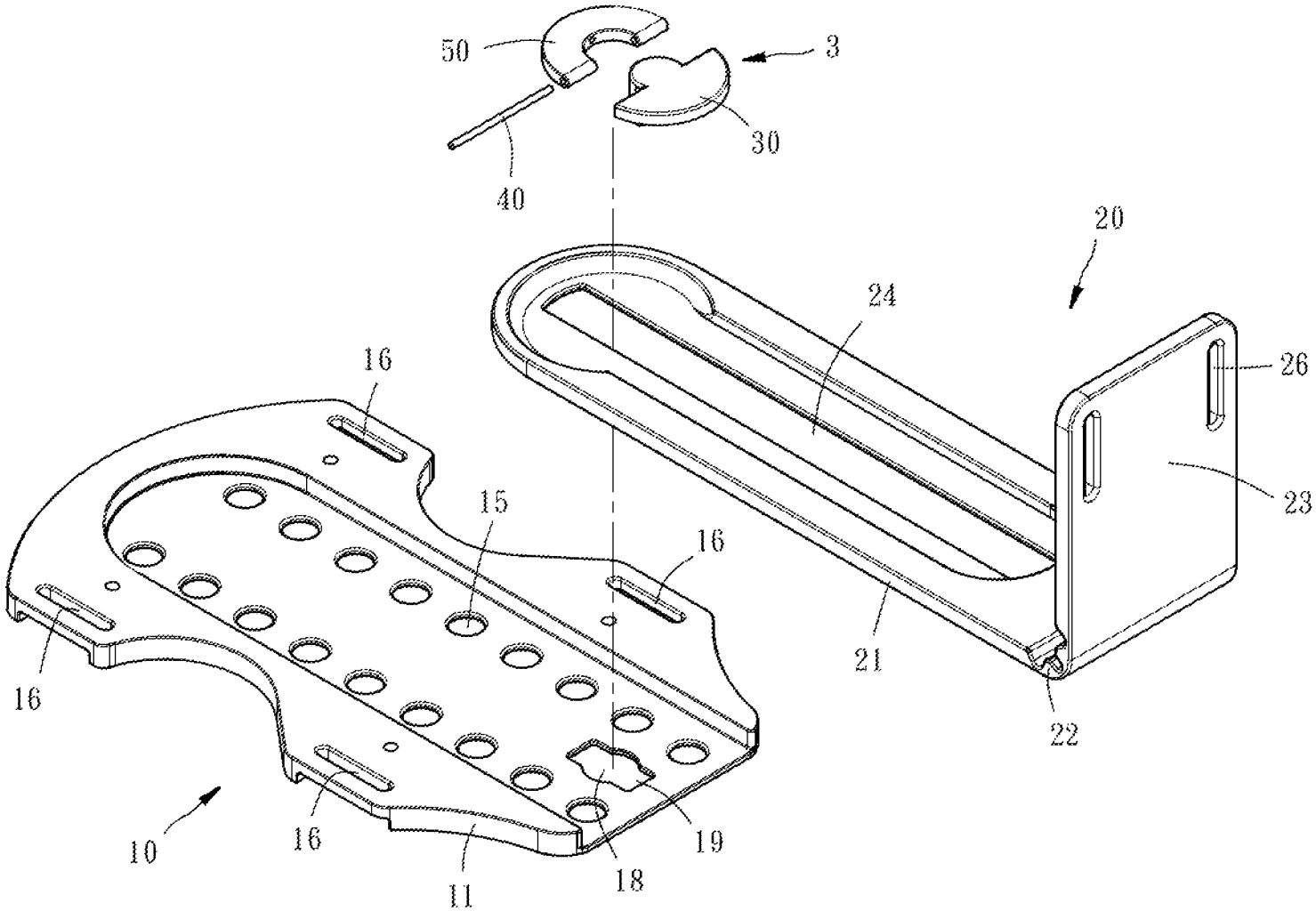
FIG. 9 is an exploded view of the load bearing unit in accordance with another preferred embodiment of the present invention.
Figure 10:
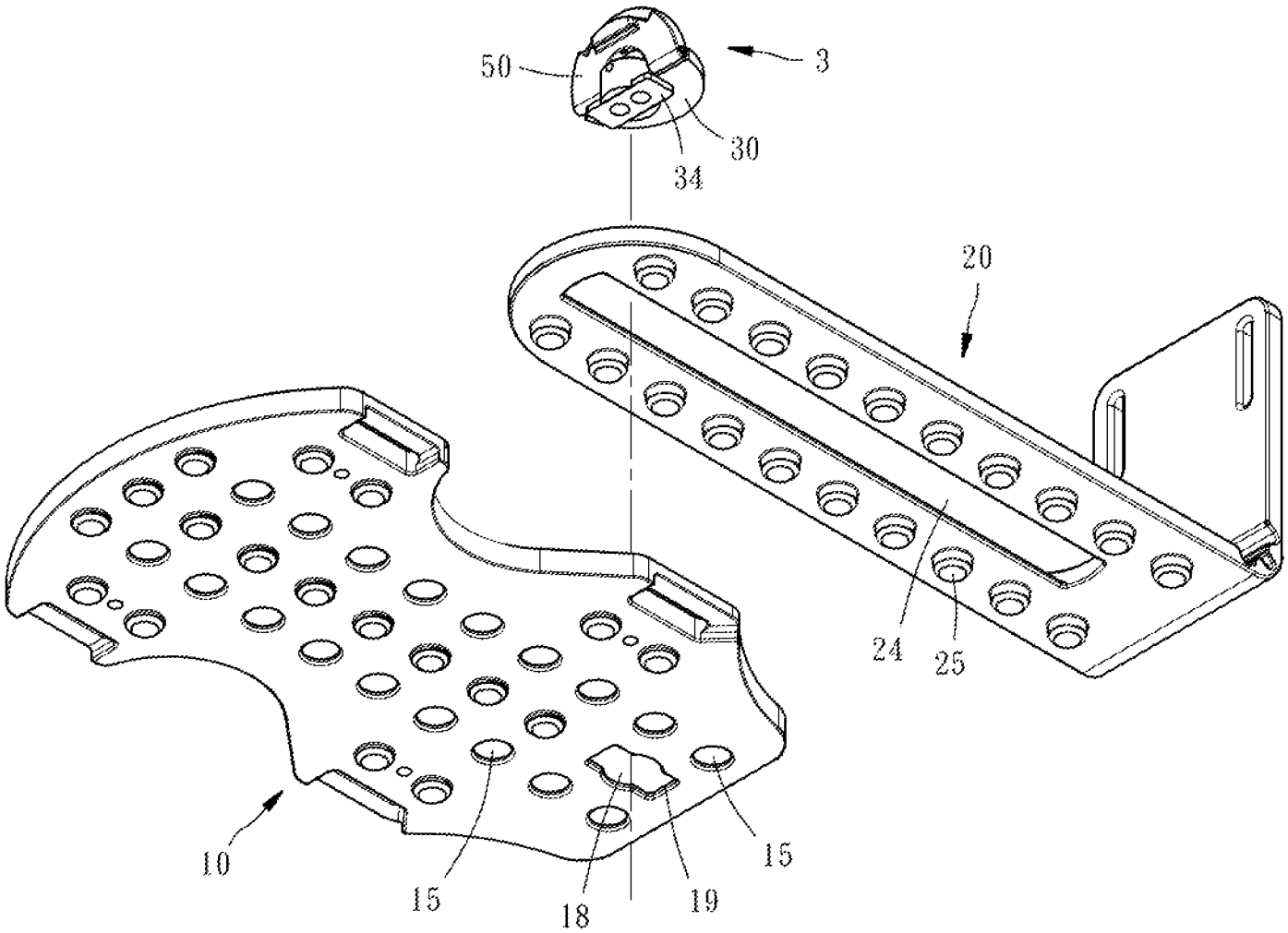
FIG. 10 is another exploded view of the load bearing unit in accordance with another preferred embodiment of the present invention.

A leg stretching and raising workout apparatus of the present invention is depicted by accompanying drawings, illustrated by embodiments, and described below.

As shown in the diagrams, the leg stretching and raising workout apparatus of the present invention essentially comprises a load bearing unit 1, a plurality of fastening units 70, and two pulling cord members 80.

The load bearing unit 1 comprises a first support component 10, a second support component 20, and a connecting member 3 for coupling together the first support component 10 and the second support component 20.

The first support component 10 has a base 11 for underpinning a shoe or foot, a bent portion 12 connected to the base 11, a front securing plate 13 connected to the base 11 by the bent portion 12, a sliding channel 14 and a plurality of positioning recesses 15 both disposed on the bottom side of the base 11, a plurality of cord penetrating openings 16 disposed at the base 11 and the front securing plate 13, respectively, an anchoring portion 17 disposed on the front securing plate 13, and a post penetrating hole 18 which penetrates the base 11 and allows two escape grooves 19 to be in communication with each other.

The second support component 20 has a bottom portion 21, a bent portion 22 connected to the bottom portion 21, a rear securing portion 23 connected to the bottom portion 21 by the bent portion 22, a slot 24 corresponding in position to the post penetrating hole 18 of the first support component 10, a plurality of positioning blocks 25 meshing with the plurality of positioning recesses 15 of the first support component 10, respectively, two cord penetrating openings 26 disposed at the rear securing portion 23, and an anchoring portion 27 disposed at the rear securing portion 23.

The connecting member 3 comprises an upper coupling component 30, a pivot 40, an operating element 50, and a lower coupling component 60.

The upper coupling component 30 is coupled to the first support component 10, whereas the lower coupling component 60 is coupled to the second support component 20.

The upper coupling component 30 has a blocking flange 31 fastenable to the first support component 10, a pivotal hole 32 penetrable by the pivot 40, a penetrating post 33 penetratingly disposed at the post penetrating hole 18 of the first support component 10, and two tenons 34 projecting from the penetrating post 33 and thus penetratingly disposed at the escape grooves 19 of the first support component 10, respectively.

The operating element 50 and the upper coupling component 30 are pivotally connected by the pivot 40 and thus can rotate relative to each other by a predetermined angle.

The lower coupling component 60 has a blocking flange 61 fastenable to the second support component 20, a rotation limiting block 62 slidably received in the slot 24 of the second support component 20 and thus not rotatable, a post penetrating hole 63 penetrable by the penetrating post 33 of the upper coupling component 30, and an escape groove 64 penetrable by one of the tenons 34 of the upper coupling component 30.

The plurality of fastening units 70 each have at least one cord 71 fastened to a corresponding one of the cord penetrating openings 16 of the load bearing unit 1, a cord fastening element 73, a cord fastening element 74 disconnectably connected to the cord fastening element 73, and a cord fastening element 75 directly penetrable by the cord 71 to enable the cord 71 to be fastened to the shoe or foot. In a preferred embodiment of the present invention, the fastening units 70 corresponding in position to the heel of the shoe or foot has a plurality of cords 71, and the cords 71 are connected by a cord ring 76.

The two pulling cord members 80 each have a pulling cord 81 and a cord connecting portion 82 connected to the pulling cord 81 so that the two pulling cord members 80 are connected to the anchoring portions 17, 27 of the load bearing unit 1, respectively. The cord connecting portions 82 of the pulling cord members 80 are clasps fastenable to fastening rings of the fastening units 70.

Operation of the leg stretching and raising workout apparatus in accordance with the preferred embodiment of the present invention is described below.

A user steps his or her shodden foot on the load bearing unit 1 and then fastens the fastening units 70 to the top surface of the shoe to ensure that the leg stretching and raising workout apparatus is fastened firmly to the shoe and unlikely to loosen.

Afterward, the user fastens the cord connecting portion 82 of the two pulling cord members 80 to the anchoring portions 17, 27 of the load bearing unit 1, respectively. From this point in time the user can stretch and raising the leg with the leg stretching and raising workout apparatus as needed.

To put off the leg stretching and raising workout apparatus, the user pulls the cord fastening element 74 to disconnect the cord fastening element 74 from the cord fastening element 73, freeing the shoe or foot from the fastening units 70.

To suit the leg stretching and raising workout apparatus to shoes or feet of any sizes, the user adjusts the position of the first support component 10 relative to the second support component 20. To this end, the user lifts the operating element 50 so that it is upright, then drives the upper coupling component 30 to rotate by rotating the operating element 50, and in consequence the tenons 34 of the upper coupling component 30 rotate to become axially corresponding in position to the escape groove 64 of the lower coupling component 60, thereby separating the upper coupling component 30 and the lower coupling component 60 from the first support component 10 and the second support component 20.

In addition to the aforesaid preferred embodiment, the present invention is illustrated by a variant embodiment described below.

For instance, the load bearing unit 1 can dispense with the connecting member 3, provided that the first support component 10 and the second support component 20 are directly coupled together.

Alternatively, the anchoring portion 17 of the first support component 10 is not restricted to a fastening ring, whereas the cord connecting portions 82 of the pulling cord members 80 are not restricted to the clasps, as they may be any means of connection or any connection mechanism formed from the cords 71.

Alternatively, the disconnectable connection between the cord fastening element 73 and the cord fastening element 74 is replaced or supplemented with direct penetration of the cords 71 into the cord fastening element 75.

According to the present invention, it is feasible for only one pulling cord member 80 to be fastened to the anchoring portion 17 of the first support component 10. Alternatively, according to the present invention, it is feasible for only one pulling cord member 80 to be fastened to the anchoring portion 27 of the second support component 20.

Alternatively, the fastening units 70 are coupled to the pulling cord members 80, respectively. Alternatively, each fastening unit 70 and a corresponding one of the pulling cord members 80 are integrally formed, for example, manufactured in the form of a single cord or sewed together.

Referring to FIG. 7 through FIG. 10, the leg stretching and raising workout apparatus in accordance with another preferred embodiment of the present invention comprises a load bearing unit 1, a fastening unit 70 and two pulling cord members 80.

The load bearing unit 1 has a first support component 10, a second support component 20, and a connecting member 3 for coupling together the first support component 10 and the second support component 20.

The first support component 10 has a base 11 for underpinning the shoe or foot, a sliding channel 14 and a plurality of positioning recesses 15 both disposed on the bottom side of the base 11, a plurality of cord penetrating openings 16 disposed at the base 11, and a post penetrating hole 18 which penetrates the base 11 and allows two escape grooves 19 to be in communication with each other.

The second support component 20 has a bottom portion 21, a bent portion 22 connected to the bottom portion 21, a rear securing portion 23 connected to the bottom portion 21 by the bent portion 22, a slot 24 corresponding in position to the post penetrating hole 18 of the first support component 10, a plurality of positioning blocks 25 meshing with the plurality of positioning recesses 15 of the first support component 10, and two cord penetrating openings 26 disposed at the rear securing portion 23.

The connecting member 3 comprises an upper coupling component 30, a pivot 40, an operating element 50, and a lower coupling component 60 and is substantially identical to the aforesaid embodiment.

The fastening unit 70 has at least one cord 71 fastened to a corresponding one of the cord penetrating openings 16 of the load bearing unit 1, and two anchoring portions 72 connected to the cord 71 and disposed on left and right sides, respectively. In this preferred embodiment, the anchoring portions 72 is an engaging ring. In a preferred embodiment of the present invention, a fastening unit 70 has a plurality of cords 71 but does not necessarily have the anchoring portions 72; in other words, the anchoring portions 72 are optional.

The two pulling cord members 80 each have a pulling cord 81 and a cord connecting portion 82 connected to the pulling cord 81 so that the two pulling cord members 80 are connected to the anchoring portions 17 of the load bearing unit 1, respectively. The cord connecting portions 82 of the pulling cord member 80 are clasps fastenable to the anchoring portions 72 of the fastening unit 70, respectively.

In this embodiment, the anchoring portions 72 of the fastening unit 70 operate in conjunction with the pulling cord member 80, thereby achieving the objectives of the present invention.

Figure 11:
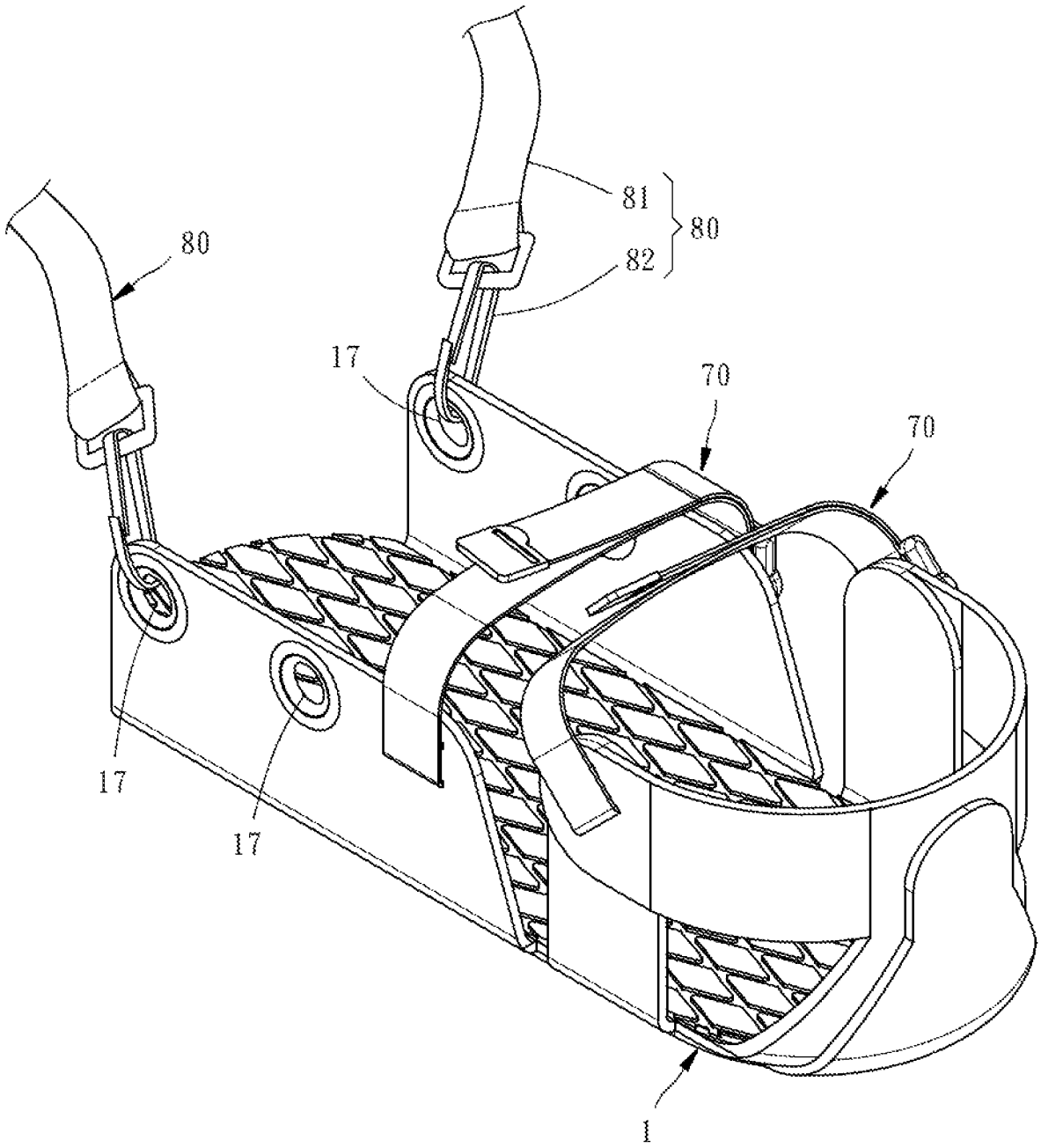
FIG. 11 is a perspective view of the leg stretching and raising workout apparatus in accordance with yet another preferred embodiment of the present invention.
Figure 12:
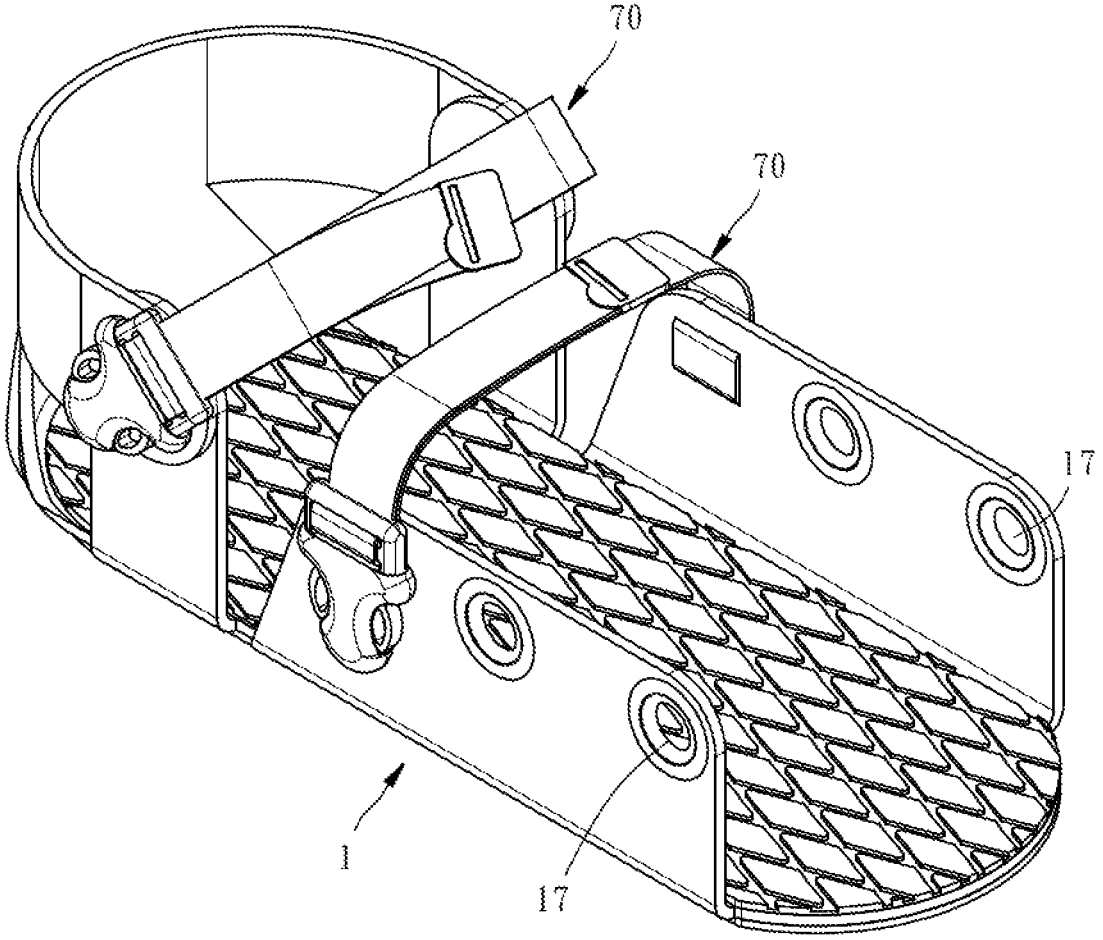
FIG. 12 is another perspective view of the leg stretching and raising workout apparatus in accordance with yet another preferred embodiment of the present invention.
Figure 13:
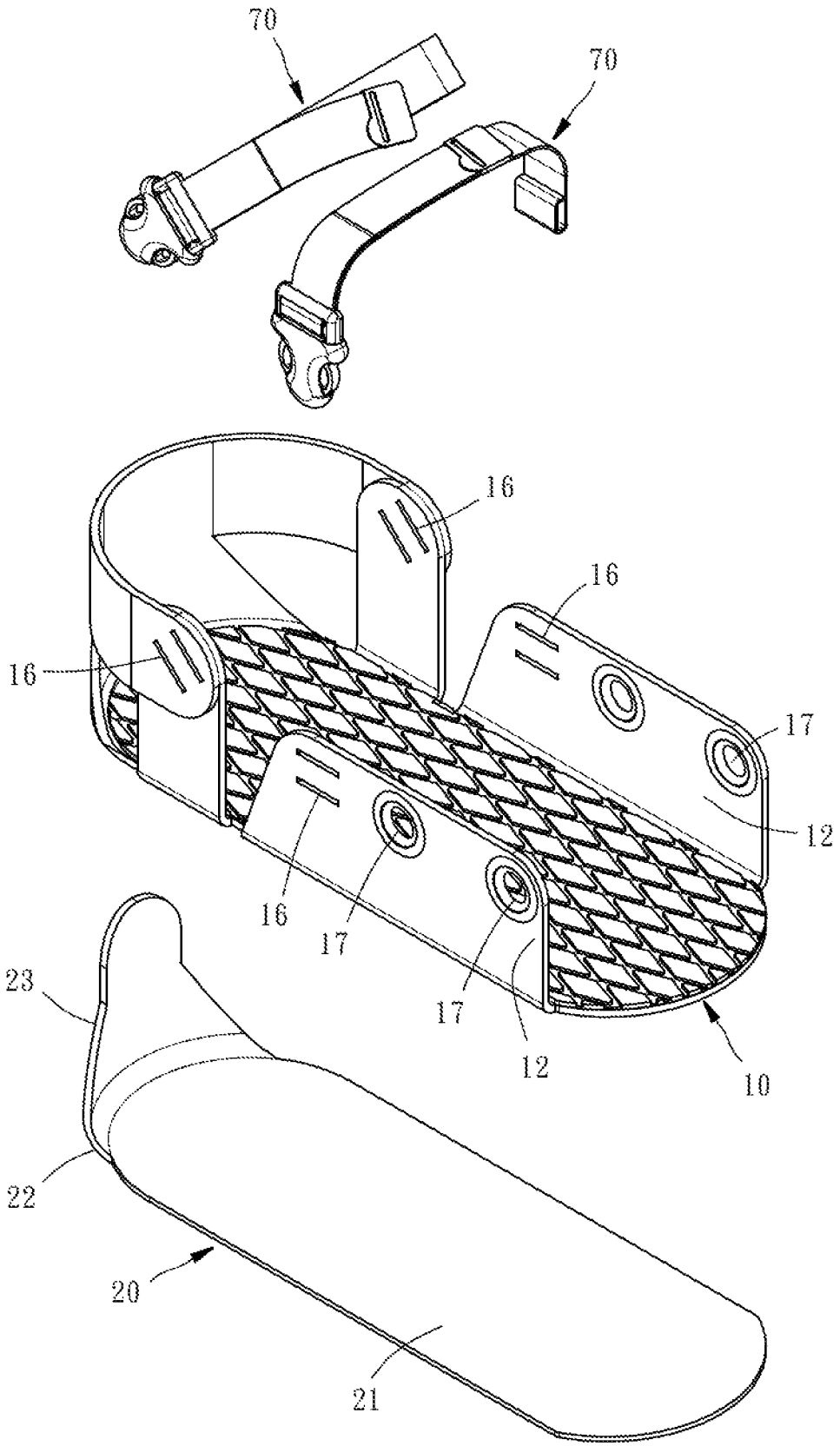
FIG. 13 is an exploded view of the load bearing unit in accordance with yet another preferred embodiment of the present invention.

Referring to FIG. 11 through FIG. 13, the leg stretching and raising workout apparatus in accordance with yet another preferred embodiment of the present invention comprises a load bearing unit 1, two fastening units 70 and two pulling cord members 80.

The load bearing unit 1 has a base 11 for underpinning the shoe or foot, a plurality of cord penetrating openings 16 disposed at the base 11, and a plurality of anchoring portions 17 disposed on two sides, respectively. In this preferred embodiment, the anchoring portions 17 are holes.

The two fastening units 70 each have a cord 71 connected to the cord penetrating openings 16 of the load bearing unit 1 and adapted to fasten the shoe or foot in place.

The two pulling cord members 80 each have a pulling cord 81 and a cord connecting portion 82 connected to a corresponding one of the anchoring portions 17 of the load bearing unit 1.

In this embodiment, the two anchoring portions 17 of the load bearing unit 1 operate in conjunction with the pulling cord member 80, thereby achieving the objectives of the present invention.

However, the structure of the load bearing unit 1 of the aforesaid embodiment is also applicable to this embodiment, as explained below.

The load bearing unit 1 has a first support component 10, a second support component 20, and a connecting member 3 for coupling together the first support component 10 and the second support component 20.

The first support component 10 has a base 11 for underpinning the shoe or foot, a sliding channel 14 and a plurality of positioning recesses 15 both disposed on the bottom side of the base 11, a plurality of cord penetrating openings 16 disposed at the base 11, and a post penetrating hole 18 which penetrates the base 11 and allows two escape grooves 19 to be in communication with each other.

The second support component 20 has a bottom portion 21, a bent portion 22 connected to the bottom portion 21, a rear securing portion 23 connected to the bottom portion 21 by the bent portion 22, a slot 24 corresponding in position to the post penetrating hole 18 of the first support component 10, a plurality of positioning blocks 25 meshing with the plurality of positioning recesses 15 of the first support component 10, and two cord penetrating openings 26 disposed at the rear securing portion 23.

The connecting member 3 comprises an upper coupling component 30, a pivot 40, an operating element 50, and a lower coupling component 60.

In conclusion, the present invention provides users with a leg stretching and raising workout apparatus which can be put on quickly and conveniently, fastened fix in place, and operated easily, achieving the objective of the present invention.

What is claimed is:

1. A leg stretching and raising workout apparatus, comprising:

a load bearing unit (1) having a base (11) for underpinning a shoe or foot and a plurality of cord penetrating openings (16) disposed at the base (11);

at least one fastening unit (70) having a cord (71) connected to the plurality of cord penetrating openings (16) of the load bearing unit (1) and adapted to fasten the shoe or foot in place, and two anchoring portions (72) disposed on left and right sides, respectively, of the at least one fastening unit (70); and two pulling cord members (80) each having a pulling cord (81) and a cord connecting portion (82) connected to a corresponding one of the anchoring portions (72) of the at least one fastening unit (70);

wherein the load bearing unit (1) has a first support component (10), a second support component (20), and a connecting member (3) for coupling together the first support component (10) and the second support component (20).

2. The leg stretching and raising workout apparatus of claim 1, wherein the connecting member (3) has an upper coupling component (30) and a lower coupling component (60), with the upper coupling component (30) coupled to the first support component (10), the lower coupling component (60) coupled to the second support component (20), allowing the upper coupling component (30) to connect pivotally to an operating element (50) with a pivot (40) and thus rotate by a predetermined angle.

3. The leg stretching and raising workout apparatus of claim 1, wherein the first support component (10) has a plurality of positioning recesses (15), the second support component (20) has a plurality of positioning blocks (25) meshing with the plurality of positioning recesses (15) of the first support component (10), the upper coupling component (30) has a tenon (34), and the lower coupling component (60) has an escape groove (64) penetrated by the tenon (34) of the upper coupling component (30).

4. The leg stretching and raising workout apparatus of claim 1, wherein the load bearing unit (1) has a bottom portion (21), a bent portion (22), and a rear securing portion (23) such that the plurality of cord penetrating openings (16) are disposed at the rear securing portion (23) and penetrable by the at least one fastening unit (70), thereby allowing the bottom portion (21) and the rear securing portion (23) to be connected by the bent portion (22).

5. A leg stretching and raising workout apparatus, comprising:

a load bearing unit (1) having a base (11) for underpinning a shoe or foot, a plurality of cord penetrating openings (16) disposed at the base (11), and two anchoring portions (17) disposed on two sides, respectively, of the load bearing unit (1);

at least one fastening unit (70) having a cord (71) connected to the plurality of cord penetrating openings (16) of the load bearing unit (1) and adapted to fasten the shoe or foot in place; and two pulling cord members (80) each having a pulling cord (81) and a cord connecting portion (82) connected to a corresponding one of the anchoring portions (17) of the load bearing unit (1);

wherein the load bearing unit (1) has a first support component (10), a second support component (20), and a connecting member (3) for coupling together the first support component (10) and the second support component (20).

6. The leg stretching and raising workout apparatus of claim 5, wherein the connecting member (3) has an upper coupling component (30) and a lower coupling component (60), with the upper coupling component (30) coupled to the first support component (10), the lower coupling component (60) coupled to the second support component (20), allowing the upper coupling component (30) to connect pivotally to an operating element (50) with a pivot (40) and thus rotate by a predetermined angle.

7. The leg stretching and raising workout apparatus of claim 5, wherein the first support component (10) has a plurality of positioning recesses (15), the second support component (20) has a plurality of positioning blocks (25) meshing with the plurality of positioning recesses (15) of the first support component (10), the upper coupling component (30) has a tenon (34), and the lower coupling component (60) has an escape groove (64) penetrated by the tenon (34) of the upper coupling component (30).

8. The leg stretching and raising workout apparatus of claim 5, wherein the load bearing unit (1) has a bottom portion (21), a bent portion (22), and a rear securing portion (23) such that the plurality of cord penetrating openings (16) are disposed at the rear securing portion (23) and penetrable by the at least one fastening unit (70), thereby allowing the bottom portion (21) and the rear securing portion (23) to be connected by the bent portion (22).

9. A leg stretching and raising workout apparatus, comprising:

a load bearing unit (1) having a base (11) for underpinning a shoe or foot and a plurality of cord penetrating openings (16) disposed at the base (11);

at least one fastening unit (70) having a cord (71) connected to the plurality of cord penetrating openings (16) of the load bearing unit (1) and adapted to fasten the shoe or foot in place, and two anchoring portions (72) disposed on left and right sides, respectively, of the at least one fastening unit (70); and two pulling cord members (80) each having a pulling cord (81) and a cord connecting portion (82) connected to a corresponding one of the anchoring portions (72) of the at least one fastening unit (70);

wherein the load bearing unit (1) has a bottom portion (21), a bent portion (22), and a rear securing portion (23) such that the cord penetrating openings (16) are disposed at the rear securing portion (23) and penetrable by the at least one fastening unit (70), thereby allowing the bottom portion (21) and the rear securing portion (23) to be connected by the bent portion (22).

10. A leg stretching and raising workout apparatus, comprising:

a load bearing unit (1) having a base (11) for underpinning a shoe or foot, a plurality of cord penetrating openings (16) disposed at the base (11), and two anchoring portions (17) disposed on two sides, respectively, of the load bearing unit (1);

at least one fastening unit (70) having a cord (71) connected to the plurality of cord penetrating openings (16) of the load bearing unit (1) and adapted to fasten the shoe or foot in place; and two pulling cord members (80) each having a pulling cord (81) and a cord connecting portion (82) connected to a corresponding one of the anchoring portions (17) of the load bearing unit (1);

wherein the load bearing unit (1) has a bottom portion (21), a bent portion (22), and a rear securing portion (23) such that the plurality of cord penetrating openings (16) are disposed at the rear securing portion (23) and penetrable by the at least one fastening unit (70), thereby allowing the bottom portion (21) and the rear securing portion (23) to be connected by the bent portion (22).

* * * * *